United States Patent [19]

Seton et al.

[11] 4,430,816

[45] Feb. 14, 1984

[54] MARKER SYSTEM

[75] Inventors: Fenmore R. Seton, North Haven; Mary R. Crespo, Hamden; Robert F. Rackliff, Stony Creek, all of Conn.

[73] Assignee: Seton Name Plate Corporation, Milwaukee, Wis.

[21] Appl. No.: 377,834

[22] Filed: May 13, 1982

Related U.S. Application Data

[63] Continuation-in-part of Ser. No. 235,935, Feb. 19, 1981, abandoned.

[51] Int. Cl.[3] ..... A44C 3/00

[52] U.S. Cl. ..... 40/2 R; 40/306

[58] Field of Search ..... 40/21 R, 21 A, 21 B, 40/21 C, 2 R, 316, 124.2, 124.4, 159, 310, 312, 306, 595, 570

[56] References Cited

U.S. PATENT DOCUMENTS

| | | | |
|---|---|---|---|
| 1,014,486 | 1/1912 | King | 40/21 B |
| 1,106,340 | 8/1914 | Bellamy | 40/595 |
| 1,830,960 | 11/1931 | Philibert | 40/595 |
| 1,960,748 | 5/1934 | Meumier | 40/21 R |
| 2,069,609 | 2/1937 | Hanson | 40/306 |
| 2,591,779 | 4/1952 | Buck | 40/595 |
| 2,596,884 | 5/1952 | Bailen | 40/21 C |
| 2,767,495 | 10/1956 | Harris | 40/310 |
| 2,914,166 | 11/1959 | Bihler | 40/2 R |
| 3,197,899 | 8/1965 | Twentier | 40/2 R |
| 3,315,386 | 4/1967 | Kest et al. | 40/2 R |
| 3,524,271 | 8/1970 | Buske | 40/2 R |
| 3,822,901 | 7/1974 | Seidman | 40/2 R |
| 3,889,407 | 6/1975 | Elzer | 40/2 R |
| 4,128,954 | 12/1978 | White | 40/2 R |
| 4,159,586 | 7/1979 | Blum | 40/2 R |
| 4,188,251 | 2/1980 | Grass et al. | 40/2 R |
| 4,249,328 | 2/1981 | Plumadore | 40/159 |
| 4,324,058 | 4/1982 | Sherwick | 40/306 |
| 4,328,057 | 5/1982 | Gutow | 40/2 R |

*Primary Examiner*—Gene Mancene
*Assistant Examiner*—Kris R. Schulze
*Attorney, Agent, or Firm*—Quarles & Brady

[57] ABSTRACT

A marker system for pipes or valves comprises a tape having a surface layer and a pressure sensitive adhesive layer, the tape defining spaced-apart transparent window areas. A release paper backing is deployed on the adhesive layer of the tape, and the release paper backing includes pre-cut window backing portions generally registered with the transparent window areas of the tape. The pre-cut window backing portions may be joined with the release paper backing along a hinge/-tear line whereby the window backing portions may be folded away from the tape. The marker system further comprises information cards sized to be adhered in the transparent window areas of the tape. The marker system is installed by first removing or folding back the pre-cut window backing portions of the release paper backing and adhering the information cards in the window area. The marker system may be installed by thereafter removing the remainder of the backing paper as the tape is wrapped around the pipe for marking the pipe or an adjacent valve; however, in marker systems where the window backing portions are hinged to the remainder of the release paper backing, the window backing portions may be positioned over the information cards, covering any exposed adhesive, and the marker system may be rolled up for storage or shipment prior to installation. In one embodiment, the release paper backing is provided in segments with alternate segments providing the window backing portions. The marker system is cut to length for installation around a pipe with the cuts being made through a blank segment of the release paper backing, so that the portions of release paper backing adjacent the ends may be removed for adhering the length of marker system to a pipe.

6 Claims, 11 Drawing Figures

MARKER SYSTEM

BACKGROUND OF THE INVENTION

This application is a continuation-in-part of application Ser. No. 235,935 filed Feb. 19, 1981 now abandoned.

This invention relates to an improved marker system for pipes and/or valves or conduits and/or switches.

It is important that pipes and/or valves and conduits and/or switches be accurately marked, particularly in complex installations, such as commercial or industrial boiler rooms, chemical plants, refineries, etc. There are many pipes and valves in such installations, and accurate marking thereof is necessary in order that personnel may quickly identify the correct pipes and valves in operating the installation in an efficient and correct manner, and perhaps more importantly, to prevent errors in operating the installation. Errors such as opening or closing the wrong valve due to misinformation as to the control function of the valve can lead to hazardous situations involving danger to personnel and equipment, and all possible steps to avoid such errors should be taken. The same criteria applies to conduits and switches for electrical wires. This necessitates the provision of a good marker system.

One marker system, currently sold under the trademark FLO-CODE, comprises tape which is opaque except for transparent window portions. The tape is provided with a continuous release paper backing. The release paper is removed as the tape is wrapped around a pipe or conduit, and informtion cards are inserted under the transparent window, also as the tape is wrapped around the pipe or conduit. The information cards are custom printed to give detailed information on the contents, pressure, temperature, etc. within the pipe, the control function of a valve in the pipe adjacent the marker, the routing of wires in a conduit or the control function of a switch. A major drawback to this marker system is that it is difficult to install, and more particularly, it is difficult to position the information cards accurately under the transparent window portions of the tape as the tape is being wrapped around the pipe or conduit. Despite this serious limitation in this marker system, it has been in widespread use for approximately twenty years. This invention relates to an improvement in the aforementioned marker system.

SUMMARY OF THE INVENTION

A marker system for pipes and/or valves or conduits and/or switches according to the invention herein comprises a tape which is opaque except for spaced-apart transparent window areas. The tape is a laminate, comprised of a surface layer which is suitable for the environment in which it is to be used, e.g. resistant to oils, moisture, chemicals, etc., and an adhesive layer for adhering information cards to the tape and for adhering the tape to the pipe. The tape is provided with a release paper backing having pre-cut window backing portions in registration with the transparent window areas of the tape. In one embodiment, the pre-cut window backing portions of the release paper backing can be peeled from the transparent window areas of the tape without disturbing the remainder of the release paper backing. In applying the marker system, the pre-cut window backing portions of the release paper backing are removed from under the transparent window areas of the tape, and information cards are positioned and adhered to the tape in registration with the transparent window areas thereof. Thereafter, the remainder of the release paper backing is first removed from one end of the tape and the exposed end of the tape adhered to the pipe. The remainder of the release paper backing is peeled from the tape as the tape is wrapped around the pipe to complete the installation of the marker system. In another embodiment, one edge of the pre-cut window backing portions is perforated so that the window backing portions may be removed from the transparent window areas of the tape, but remain hingedly attached to the main portion of the release paper backing. The information cards are inserted and the window backing portion of the release paper is positioned over the information cards, thereby covering any adhesive which remains exposed due to undersized information cards or slight mis-registration of the information cards in the window area of the tape. Thus, the information cards can be installed by the supplier of the marker system, and the tape with the information cards installed can be rolled up and shipped to the user without any possibility of the tape adhering to itself in the rolls. Both structures permit positioning of the information cards under the transparent window areas of the tape prior to wrapping the tape around the pipe and thereby avoids the difficult task of trying to position the information cards under the transparent window areas of the tape in the midst of wrapping the tape about the pipe.

In a further embodiment, the release paper backing is provided in segments separated by transverse cuts, with alternate segments having the pre-cut window backing portions. Installation is accomplished by inserting information cards in the transparent window areas, as described above, and by cutting a length of the tape from a supply roll. The length of marker cut from the supply roll is sufficient to wrap around the object pipe and to lap onto itself, and the cut is made through the tape and release paper backing approximately midway in one of the segments which does not have an information card. The release paper backing is removed adjacent one end of the cut length of marker, and that end is adhered to the pipe. The marker is wrapped about the pipe, and the release paper backing is removed from the other end and the tape is adhered to itself. The release paper backing intermediate the ends is left in place.

Also according to the invention herein, the pre-cut portions of the release paper backing under the transparent window areas of the tape may be provided with tabs which facilitate removing the pre-cut portions of the release paper backing. The information cards are also provided with correspondingly shaped and positioned tabs. The tab areas of the information cards are registered with the exposed area of the tape from which the tab areas of the release paper were removed, which facilitates positioning of the crads under the transparent window areas of the tape.

Accordingly, it is a principal object of the invention herein to provide an improved marker system for pipes and/or valves.

It is an additional object of the invention herein to provide an improved marker system for pipes and/or valves which provides for display of information cards and which is easily installed on a pipe, including the mounting of the information cards in the proper positions.

Other features and objects of the invention herein will in part be obvious and will in part appear from the perusal of the following description of the preferred embodiments and the claims, taken together with the drawings.

DRAWINGS

The same reference numerals refer to the same elements throughout the various figures.

DESCRIPTION OF PREFERRED EMBODIMENTS

Figure 1:
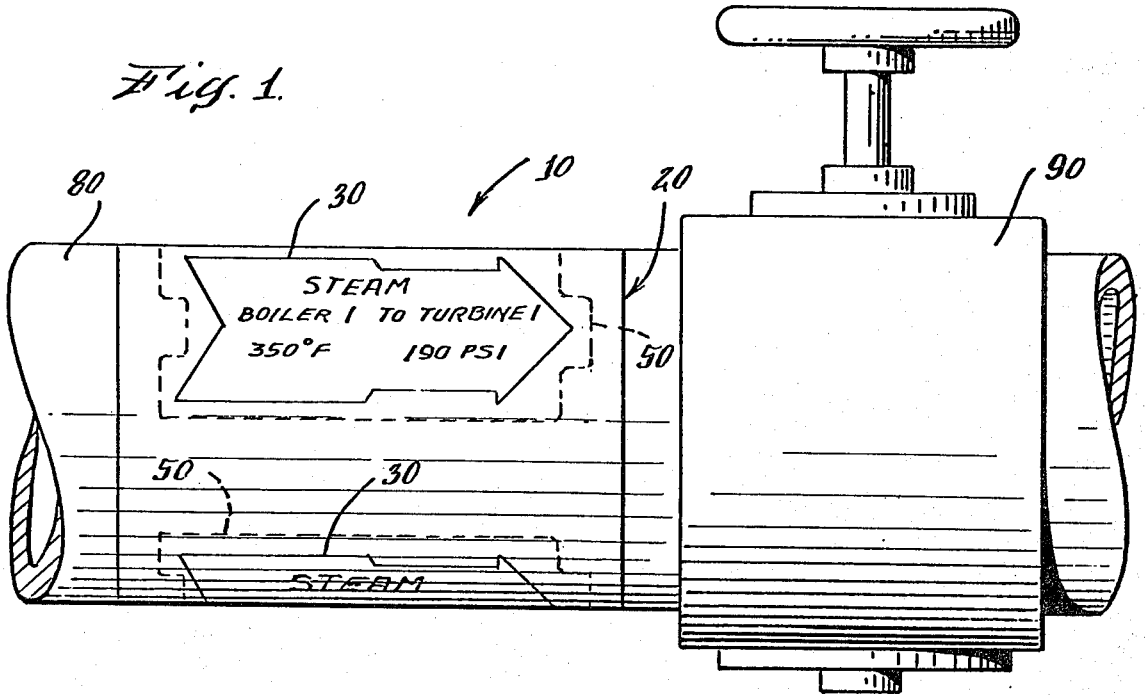
FIG. 1 is a side elevation view of a marker system according to the invention herein installed on a pipe adjacent to a valve for marking either the pipe or the valve.
Figure 2:
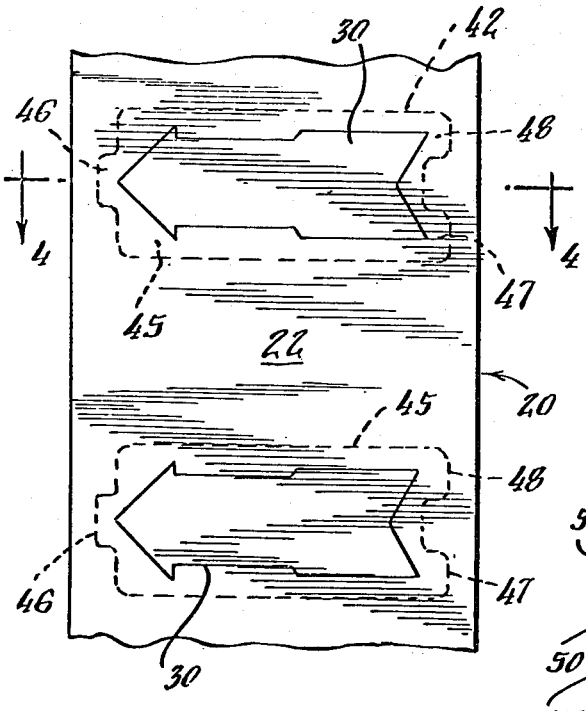
FIG. 2 is a plan view of the front of the marker system of FIG. 1.
Figure 3:
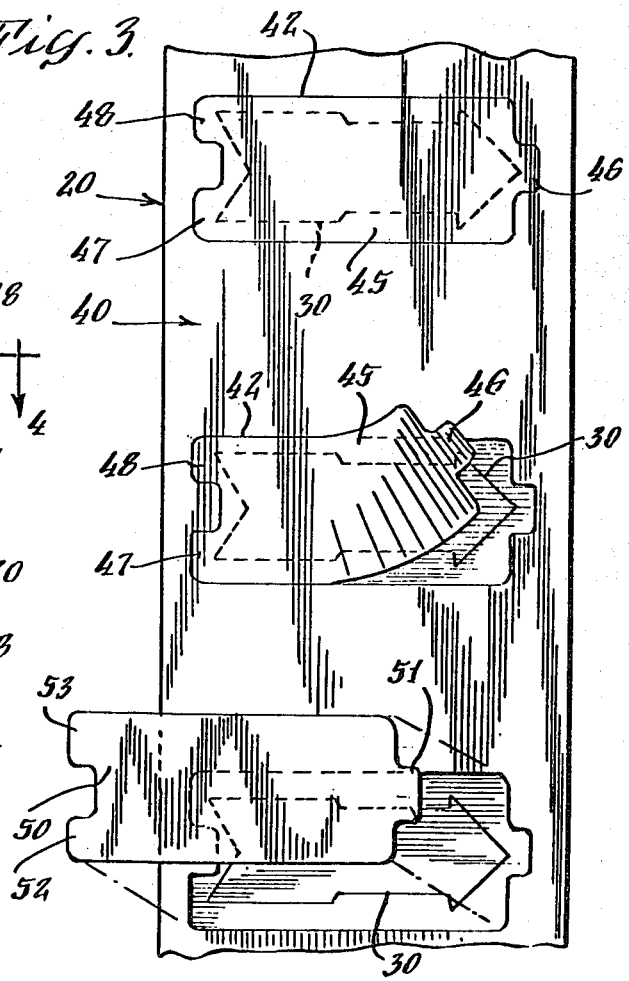
FIG. 3 is a plan view of the back of the marker system of FIG. 1 and also illustrating installation of information cards.
Figure 4:
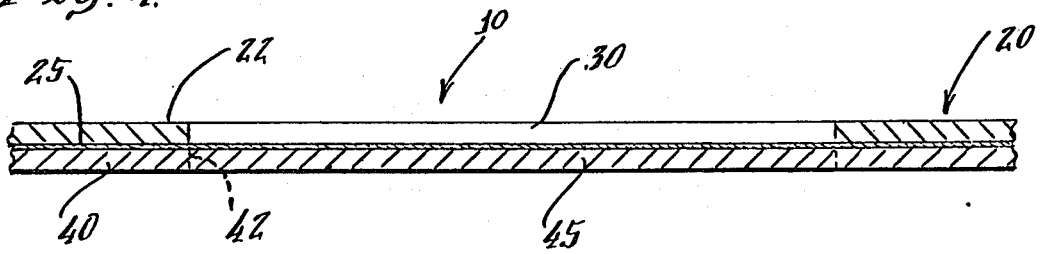
FIG. 4 is a sectional view of the marker system of FIG. 1, taken along the lines 4—4 of FIG. 2.
Figure 5:
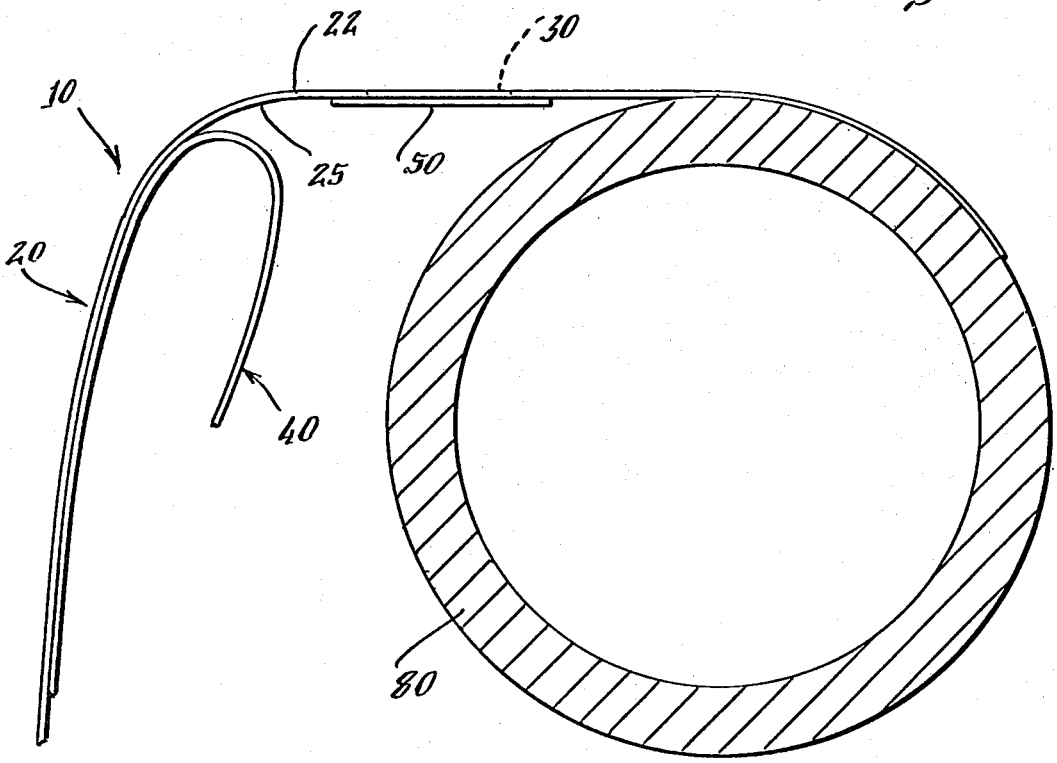
FIG. 5 is a side elevation view showing the marker system of FIG. 1 being installed on a pipe.

A marker system 10 according to the invention herein is illustrated in FIGS. 1–5. It generally comprises a tape 20 having transparent window areas 30; a release paper backing 40 including pre-cut portions 45 registered with the window areas 30 of the tape 20, and information cards 50 which are adhered under the window areas 30 in the installed marker system. FIGS. 3 and 5 illustrate steps in the installation of the marker system 10 on a pipe 80 adjacent a valve 90, and the marker system is shown fully installed in FIG. 1.

The tape 20 comprises an outer or surface layer 22 which may be a plastic material, such as Mylar or another plastic, the material being chosen with consideration of the environment in which the marker system 10 is to be used. In this regard, the marker system 10 is useful for marking in all different types of environments, i.e., where there are pipes and valves carrying all manner of substances, including water, steam, oils, and various chemicals. It will be appreciated that the material from which the surface layer of the tape is fabricated may be varied, depending upon the application.

The window areas 30 of the surface layer 22 are transparent, and the remainder of the surface layer 22 surrounding the window areas 30 is opaque. The opaque areas of the tape may be color-coded to provide an indication of the contents of the pipe on which the marker system is used. The window areas 30 of the tape 20 are preferably shaped in the form of arrows, as best seen in FIGS. 1 and 2, wherein the marker system may be installed with the arrows indicating the direction of flow through the marked valve or pipe.

The tape 20 further comprises an adhesive layer 25, the adhesive preferably comprising a pressure sensitive adhesive which is self-adhered to the surface layer 22 and which is also chosen with regard to the environment in which the marker system is to be employed. The adhesive layer is also transparent, so that the information cards 50 of the marker system 10 can be viewed through the transparent window areas 30 and the adhesive layer.

The tape 20, and more particularly the adhesive layer 25 thereof, is provided with a release paper backing 40 which covers the adhesive layer 25 during storage and handling prior to installing the marker system 10. Release paper backings per se are well-known in the art, and readily peel away from the adhesive which they cover. According to the invention herein, the release paper backing 40 is pre-cut at 42, as best seen in FIG. 3, to provide separated window backing portions 45. The window backing portions 45 are registered under the window areas 30 of the tape 20, and can be peeled off to expose the adhesive layer 25 under the window areas 30 while the remainder of the release paper backing 40 covers the remainder of the adhesive layer 25. In the preferred embodiment illustrated, the die cut window portions 42 have tab portions 46, 47 and 48, the tab portion 46 generally overlaying the point of the arrow-shaped transparent window areas 30 and the tab portions 47 and 48 overlaying the feather portions of the arrow-shaped transparent window, but the tabs are not essential to the invention and the pre-cut window backing portions may be rectangular or any other desired shape.

The marker system 10 further comprises information cards 50, which are preferably shaped and sized the same as the pre-cut window backing portions 45 of the release paper 40. The information cards 50 have information custom printed or written thereon to indicate the contents, pressure, temperature or other pertinent information concerning the contents of the pipe or the control function of the valve on which the marker system is used or any other desirable pertinent information.

With reference to FIGS. 1, 3 and 5, the installation of the marker system 10 is illustrated. The tape 20 may be provided in rolls having a length sufficient to mark several pipes or valves, and as a first step in using the marker system 10 the desired length of tape 30 may be cut from the roll. The desired length of tape is usually somewhat greater than the circumference of the pipe, i.e. the desired length is sufficient for the tape to overlap upon itself when installed. The tape may next be positioned as shown in FIG. 3, and the pre-cut window backing portions 45 of the release backing paper 40 removed to expose the adhesive layer 25 under the window areas 30 of the tape. The tabs 46, 47 or 48 are somewhat useful in this regard, providing a convenient starting point for peeling away the pre-cut window backing portions 45. With further reference to FIG. 3, the information cards 50 are inserted and adhered to the adhesive layer of the tape in the area exposed by the removal of the pre-cut window backing portions 45. The tab portions 51, 52 and 53 of the information cards 50 fit into the areas vacated by the tabs 46, 47 and 48 of the pre-cut window backing portions, and this configuration assists in registering the information cards under the window areas 30.

The release paper backing 40 is then peeled away from one end of the tape 20, and the exposed end of the tape 20 is adhered to the pipe 80 via the adhesive layer 25. The tape 20 is then wrapped around the pipe 80, the release paper backing 40 being peeled away in advance of the tape's contact with the pipe 80, as best illustrated in FIG. 5. When the release paper backing 40 has been fully removed, the adhesive layer 25 of the tape is fully exposed for adhering completely around the pipe and overlapping onto the surface layer 22 of the tape.

It will be noted that the window areas of the tape are separated from the lateral edges of the tape, whereby the tape is adhered to the pipe surrounding the information cards and the information cards are protected from coming into contact with water, oil, grease, etc. which might develop on the surface of the pipe. Once the installation is complete, the release paper backing is merely thown away.

Figure 6:
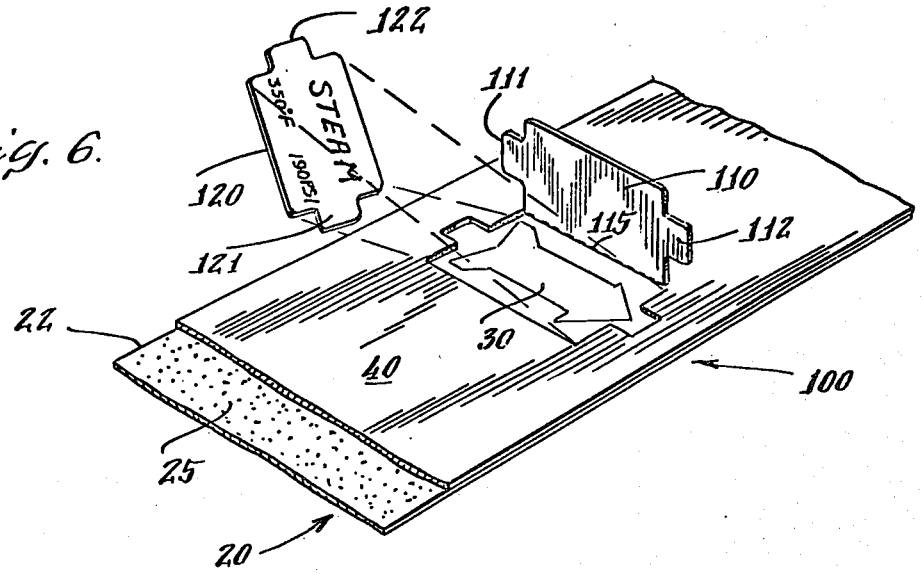
FIG. 6 is a perspective view of another marker system according to the invention herein.
Figure 7:
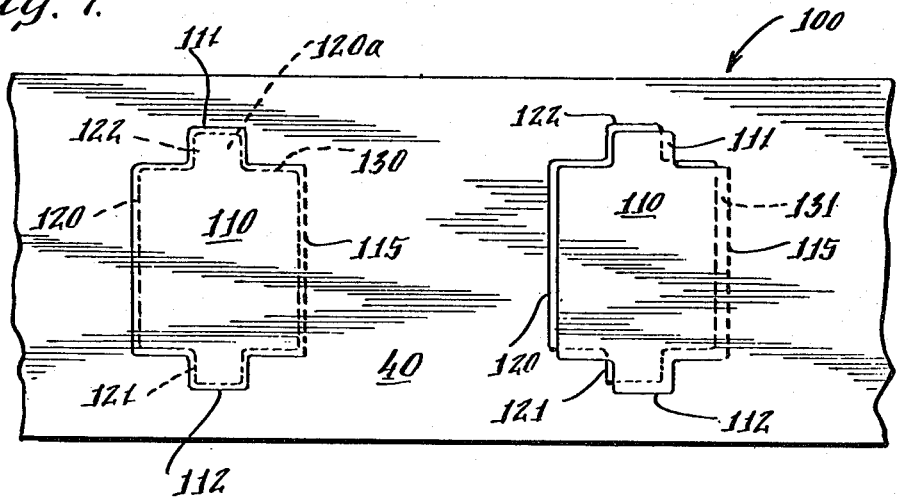
FIG. 7 is a top plan view of the marker system of FIG. 6.
Figure 8:
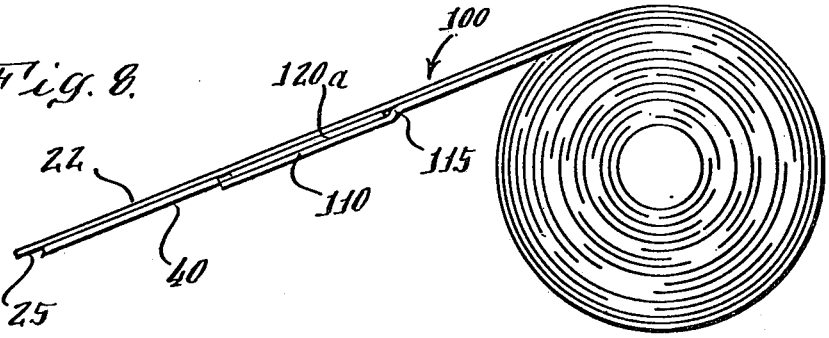
FIG. 8 is a side view of the marker system of FIG. 6, with information cards installed and being rolled for shipping.

With reference to FIGS. 6–8, another marker system 100 according to the invention herein is shown. The marker system 100 is similar to the marker system 10 above and generally comprises a tape 20 having transparent window areas 30 and an adhesive layer 25, a release paper backing 40 including window backing portions 110, and information cards 120.

The marker system 100 differs from the marker system 10 described above primarily in that each window backing portion 110 of the release paper backing 40 is pre-cut from the surrounding backing paper on three of its marginal edges and its fourth marginal edge is joined to the release backing paper at a perforated hinge/tear line 115. This permits the window backing portion 110 of the release paper backing 40 to be lifted from the adhesive layer 25 in the transparent window areas 30, the window backing portion being folded along the perforated hinge/tear line 115 in order to expose the window area 30 for placing an information card 120 thereon, as illustrated in FIG. 1. The window backing portion 110 may be removed from the release paper backing by tearing it along the hinge/tear line 115, whereby the marker system 100 may be used in the same manner as described above with respect to the marker system 10.

As an important feature of the marker system 100, the window backing portion hinge/tear line 115 also permits the window backing portion 110 to remain attached to the remaining release paper backing as and after the information cards are mounted in the window areas, and this feature is particularly valuable when the marker system 100 is to be rolled up for storage or shipment after the information cards are installed. More particularly, the information cards 120 may in certain instances be sized slightly smaller than the window backing portion 110, and with reference to FIG. 7, the information card **120*a* is somewhat smaller than the window backing portion wherein an area of adhesive, indicated at 130, remains exposed after the information card is installed. Also, even if the information card is correctly sized, it may not be positioned in exact registration with the adhesive exposed by the window backing portion, whereby an area of adhesive remains exposed after the information card is installed. This is also illustrated in FIG. 7, wherein information card 120 is shown installed in the marker system 100, leaving an exposed area of adhesive indicated at 131. In both of these instances, the window backing portion 110 is folded back into alignment with the tape 20 and the release paper backing 40, thereby overlaying the information card and covering the exposed areas of adhesive 130, 131**.

Therefore, in utilizing the marker system 100, the information cards may be pre-installed by the supplier or by the end user while the marker system 100 remains in long strips, and the long strips may be rolled up for storage and/or shipment without sticking together. When it is desired to install the marker system 100, the desired length of the marker system has been cut from the roll, one end of the release paper backing is peeled up and the tape is adhered to the pipe or conduit. The remainder of the release paper backing, including the window backing portions 110, is removed from the tape as the tape is wrapped about the pipe or conduit.

The marker system 100 also differs from the marker system 10 in that the window backing portions 110 are symmetrical, each having two protruding tab areas 111 and 112 extending from opposite edges thereof. The information cards may also by symmetrical having matingly configured tabs 121 and 122, and may be oriented as desired in placing them under the transparent window areas 30. As an example, when the transparent window areas are in the form of an arrow, the information cards can be positioned to permit installation of the marker system with the arrows pointed in either direction and the information on information cards oriented right side up for reading. The information cards can be installed in the window areas alternately right side up and upside down so that one-half of the information cards are right side up regardless of which direction the arrows are pointed in the final installation, which also facilitates reading the information cards from opposite sides of a pipe or conduit.

Figure 9:
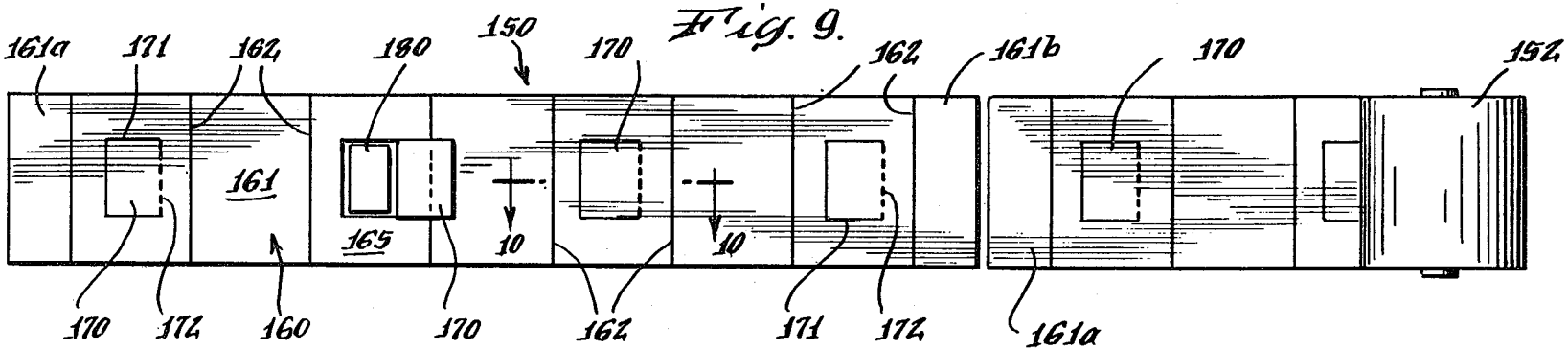
FIG. 9 is a plan view of the back of another marker system according to the invention herein.
Figure 10:
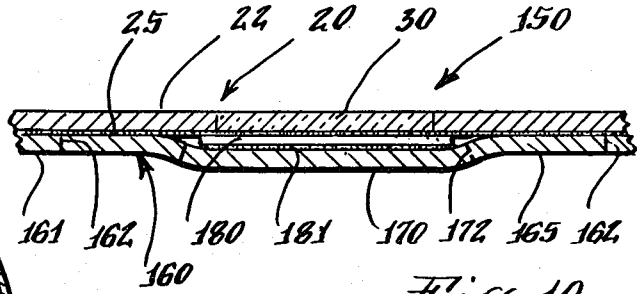
FIG. 10 is a sectional view of the marker system of FIG. 9, taken along the lines 10—10 of FIG. 9.
Figure 11:
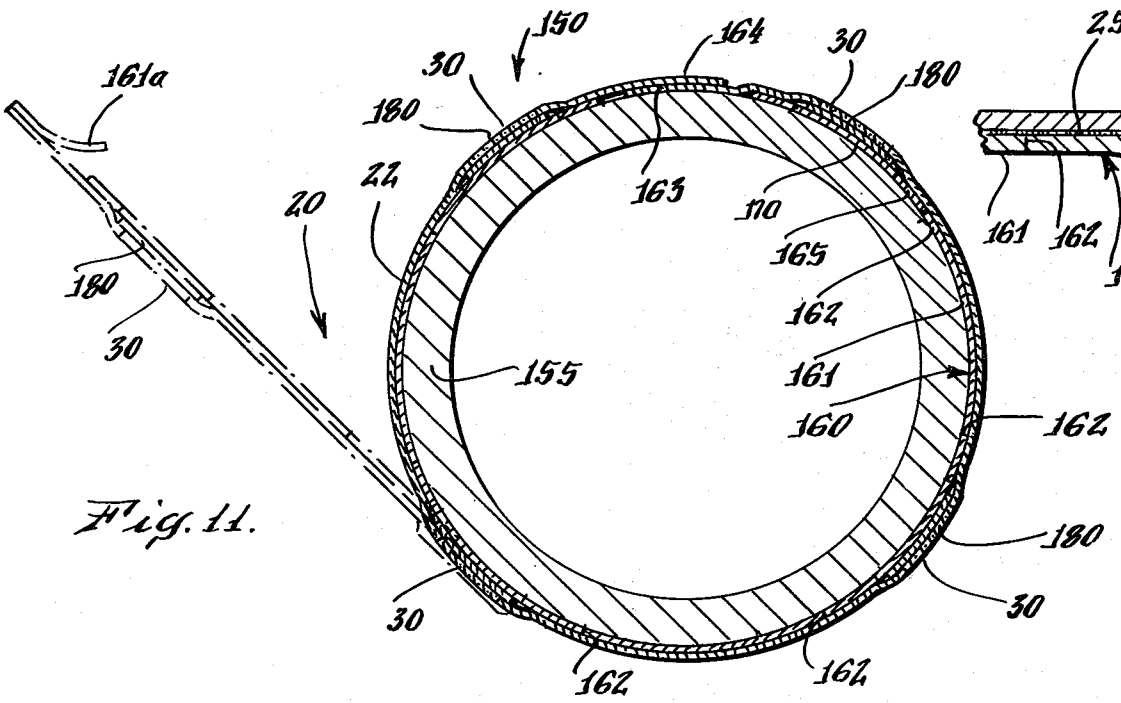
FIG. 11 is a sectional view of a length of the marker system of FIG. 9 installed on a pipe.

A marker system 150, also according to the invention herein and shown in FIGS. 9–11, first comprises a tape 20 as described above, including a surface layer 22 having transparent window areas 30 and an adhesive layer 25. The marker system 150 further generally comprises a release paper backing 160 and information cards 180.

The release paper backing 160 is divided into segments 161 and 165 by transverse cuts 162. The segments 161 and 165 may have approximately the same length. The segments 165 each include a pre-cut window backing portion 170, which are each preferably pre-cut from surrounding backing paper on three marginal edges by a continuous cut 171, and have a fourth marginal edge joined to the remainder of the release paper backing at a perforated or pre-scored hinge line 172. This permits the window backing portions 170 to be lifted from the adhesive layer 25 in the transparent window areas 30, each window backing portion being folded along its hinge line 172 in order to expose the window area 30 for placing an information card 180 thereon. The window backing portions 170 are shown generally rectangular, but may have tabs as described above, if desired.

The information cards 180 are preferably sized and shaped to fit into the area exposed by lifting the window backing portions 170. The information cards also preferably have an adhesive layer 181 on their rear surfaces, and are provided with their own release paper backing, not shown, for ease of handling. Thus, as best seen in FIGS. 9 and 10, an information card 180 is fitted into the area exposed by lifting the pre-cut window portion 170 and is adhered by the adhesive layer 25 to the surface layer 22 of the tape 20 with the information printed on the information card visible through the transparent window area 30. The pre-cut window backing portion 170 is then folded back toward its original position and adhered to the back of the information card 180 by the adhesive layer 181 on the back thereof. Thus, the marker system 150 may be rolled up for shipment, as indicated by roll 152 in FIG. 9, and lengths of the marker system 150 may be handled, all without any of the adhesive layers being exposed.

With reference to FIGS. 9 and 11, the marker system 150 is cut into lengths sufficient for wrapping about a pipe 155, with the cuts being made transversely through the tape 20 and the release paper backing 160 approximately midway along one of the segments 161 of the release paper backing, dividing the segments 161 into portions 161*a* and 161*b*. The marker system is then installed on the pipe 155 by removing the portion 161*b* of the release paper backing adjacent one end, exposing the adhesive layer 25 of the tape 20 at the end of length of the marker system 150. This exposed end is adhered to the pipe at 163, the length of the marker system 150 is wrapped about the pipe, and the portion 162*a* of the release paper backing is removed to expose the adhesive layer 25 at the other end of the length of marker system 150. This portion of the adhesive is adhered to the top of the tape 20 previously adhered to the pipe, as shown at 164. Thus, the length of the marker system 150 is adhered to the pipe and to itself, which is sufficient to mount it about the pipe 155, and the release paper backing 160 between the ends of the lengths of marker system remains in place in the final installation. The installation is easily accomplished because there is no requirement to handle the length of marker system with large areas of adhesive exposed.

It will further be appreciated that the feature of providing the release paper backing in segments separated by transverse cuts is applicable in a marker system comprising a pre-printed tape. Thus, another marker system according to the invention comprises a tape having a surface layer and a pressure sensitive adhesive layer, wherein the surface layer carries pre-printed information or symbols. Release paper backing is provided in segments separated by transverse cuts. To install the marker system, a length of the marker system is cut from a supply roll, with the cuts being made approximately midway along one of the segments of release paper backing. The portion of release paper backing between one of the end cuts and the next-adjacent transverse cut is removed to expose the adhesive, and the tape is adhered to an object pipe or conduit. The marker system is wrapped about the pipe or conduit and the portion of release paper backing adjacent the other end is removed, exposing the adhesive for adhering the other end of the tape, preferrably in overlapping relation with the first, already positioned and adhered end.

It will be appreciated that the width of the tape, the size and shape of the window portions and the spacing or the window portions from each other may vary in all the embodiments depending upon the size of the pipe with which the marker system is intended for use.

Accordingly, the preferred embodiments described above admirably achieve the objects of the invention herein. However, those skilled in the art will recognize that various changes can be made in the preferred embodiments described above without departing from the spirit and scope of the invention, which is limited only by the following claims.

We claim:

1. A tape system for marking pipes, comprising:

a front protective layer having a transparent window area;

a pressure sensitive adhesive layer formed on a back side of the protective layer;

a release backing releasably deployed against the adhesive layer behind the front protective layer, the release backing having a pre-cut window backing portion generally registered with said transparent window area and a handling portion defined by the remainder of the release backing;

said pre-cut window backing portion being removable from the adhesive layer and the handling portion so as to expose a portion of the adhesive layer adjacent the transparent window, while leaving another portion of the adhesive layer covered by the handling portion; and an information card sized to be adhered against the back of the transparent window area within the area which is exposed by the removal of the pre-cut window backing.

2. A tape system in accordance with claim 1, wherein the handling portion of the backing is pre-cut by transverse cuts so as to be divided into a starter section on the lead side of the window backing portion, a middle portion surrounding the window backing portion, and an end section on the opposide side of the window backing portion from the starter section, said starter, middle and end sections being formed such that each can be readily removed from the adhesive layer separately from each other and separately from the window backing portion.

3. A tape system in accordance with claim 1, wherein the information card has a front information containing side and a rear side having a layer of pressure sensitive adhesive, whereby the window backing portion may be adhered to the information card rear side following installation of the information card against the back of the transparent window area.

4. A tape system in accordance with claim 1, wherein the pre-cut window backing portion is joined with the handling portion along a hinge line, whereby the window backing portion may be folded away from the adhesive layer along the hinge to allow installation of the information card, and may be pivoted back to cover substantially all of the exposed adhesive remaining in the transparent window area after the information card has been installed.

5. A method of installing a marking tape on a pipe, the tape including a front protective layer with a transparent window area, a pressure sensitive adhesive layer formed on a back side of the protective layer, a release backing releasably deployed against the adhesive layer behind the front protective layer the release backing having a pre-cut window backing portion generally registered with said transparent window area, and an information card sized to be adhered against the back of the transparent window area within the area which is exposed by the removal of the pre-cut window backing, with the information cord being substantially surrounded by a portion of the backing comprising the steps of:

selecting a length of the tape which is greater than the outer circumference of the pipe;

removing a portion of the release backing adjacent the window area from the adhesive layer so as to expose the back side of the window area, while leaving a handling portion of the backing in place against the adhesive layer;

installing the information card against the exposed window area;

removing at least a starter portion of the handling portion adjacent the lead end of the tape so as to expose the adhesive under the starter portion, and positioning that end of the tape on the pipe;

wrapping the remainder of the selected tape length around the pipe until the tape overlaps on itself; and pressing the overlapped portion of the tape onto the top of the tape beneath it.

6. The method of claim 5, wherein a portion of the backing substantially surrounding the information card remains on the adhesive even after the tape has been installed.

* * * * *